US006418287B1

(12) United States Patent
Jackson

(10) Patent No.: US 6,418,287 B1
(45) Date of Patent: Jul. 9, 2002

(54) BELT DRIVE FOR ONE OR MORE PHOTOCONDUCTOR DRUMS

(75) Inventor: Bruce J. Jackson, Star, ID (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/520,759

(22) Filed: Mar. 7, 2000

(51) Int. Cl.[7] ..... G03G 15/00
(52) U.S. Cl. ..... 399/167; 399/303
(58) Field of Search ..... 399/167, 303, 399/312

(56) References Cited

U.S. PATENT DOCUMENTS 3,976,370 A * 8/1976 Goel et al. ..... 399/312
5,212,532 A * 5/1993 Storlie
5,799,232 A * 8/1998 Tompkins et al. ..... 399/167
5,899,603 A * 5/1999 Markovics ..... 399/167
5,978,642 A * 11/1999 Arcaro et al. ..... 399/381
6,008,826 A 12/1999 Foote et al. ..... 347/116
6,118,465 A * 9/2000 Arcaro et al. ..... 399/167 X

* cited by examiner

*Primary Examiner*—Fred L. Braun

(57) ABSTRACT

A belt drive operative to rotate one or more photoconductor drums while carrying media sheets past the rotating drum or drums. For single pass color printers in which the different color planes are developed using a series of photoconductor drums, a substantially flat movable belt is positioned adjacent to and extends across each of the drums. The belt simultaneously engages each drum so that movement of the belt past the drums causes the drums to rotate together as the belt carries media sheets past the rotating drums. In one preferred version of the invention, grit applied to the ends of the drum(s) and/or to the edge of the belt is used to transfer driving force from the belt to the drums.

2 Claims, 5 Drawing Sheets

BELT DRIVE FOR ONE OR MORE PHOTOCONDUCTOR DRUMS

FIELD OF THE INVENTION

The present invention is directed to a system for reducing banding and color plane registration errors in an image forming device and, more particularly, to a belt drive operative to rotate one or more photoconductor drums while carrying media sheets past the rotating drum or drums.

BACKGROUND

To print in color, electronic data representing a desired print image is initially separated into four distinct color planes; one cyan, one magenta, one yellow, and one black. Single pass full color laser printers generally include a sequence of developer stations each responsible for producing one color plane image. As a sheet of paper or other suitable media passes through the first developer station, the first color plane of the separated print image is applied. The full color print image is formed as the paper passes through the other three developer stations with each of the remaining color plane images being superimposed over the first.

Each developer station includes an insulating photoconducting material usually placed on a drum and a light source such as a scanning laser. Repeatedly scanning a beam across the drum in a series of precise lines, the scanning laser creates a latent image corresponding to one color plane on the drum's surface by selectively exposing areas of the photoconductor drum to light. A difference in electrostatic charge density is created between the areas on the drum exposed and not exposed to light. The visible image is developed by electrostatic toners. The photoconductor drum may be either positively or negatively charged, and the toner system similarly may contain negatively or positively charged particles. The toners are selectively attracted to the portions of the photoconducting surface either exposed or unexposed to light, depending on the relative electrostatic charges of the photoconductor drum and the toner. A transfer roller is given an electrostatic charge opposite that of the toner and is rotated close to the photoconductor drum. The transfer roller pulls the toner from the surface of the photoconductor drum onto a sheet of paper or other print media in the pattern of the color plane image developed from the photoconducting surface. The full color image is produced as each color plane image is transferred and fused to the media sheet.

Since laser printers are designed to run very quickly, problems can arise with even slight variations in photoconductor drum speeds. Variations in photoconductor drum speed appear on the printed page as increased or decreased spacing between lines and visually appear as "bands." Banding can be a particularly severe problem for laser printers when printing full color images such as photographs. In addition to banding, varying photoconductor drum speeds cause color plane registration errors. To produce accurate color prints, each successive color plane image must be precisely aligned and superimposed over the prior color plane. Color plane registration errors exceeding as little as about fifty microns, for example, produces a detectable degradation in print quality.

The principle cause of varying drum speeds is gear noise. Photoconductor drums are generally driven by a stepper motor or a brushless DC motor in connection with a gear array. Gear noise results from imperfect spacing of gear teeth, variances in flexing of gear teeth as forces are transferred from one gear to the next, and other intrinsic variations in gear force transfer. The stepper motor can also contribute to the problem because, as it drives the gear array in a laser printer, it may have slight variations in angular velocity due to the multiple magnet positions for each step.

Past solutions to banding and color plane registration errors include providing helical gears or gears made of better materials or with greater precision. These gears add significantly more expense to the final product. Solutions specific to correct banding include providing sensors to detect undesired variations in the photoconductor drum speed and additional circuitry directed to compensate the modulation of the laser accordingly. Solutions specific to registration errors include sensing variations in the speeds of the photoconductor drums and correspondingly adjusting the timing of the scanning lasers to correct the placement of each color plane image. Unfortunately, each of these solutions, requiring additional circuitry, sensing capabilities, and precision components and machining, substantially increase the manufacturing costs of an image forming device.

SUMMARY

The present invention is directed to a belt drive operative to rotate one or more photoconductor drums while carrying media sheets past the rotating drum or drums. For single pass color printers in which the different color planes are developed using a series of photoconductor drums, a substantially flat movable belt is positioned adjacent to and extends across each of the drums. The belt simultaneously engages each drum so that movement of the belt past the drums causes the drums to rotate together as the belt carries media sheets past the rotating drums. In one preferred version of the invention, grit applied to the ends of the drum(s) and/or to the edge of the belt is used to transfer driving force from the belt to the drums. Conventional single pass color printers that use a paper transport belt to carry paper through the developer stations can be readily adapted to use the invention. It is expected that the invention will provide a cost effective alternative to conventional methods for reducing banding and registration errors.

DETAILED DESCRIPTION

Figure 1:
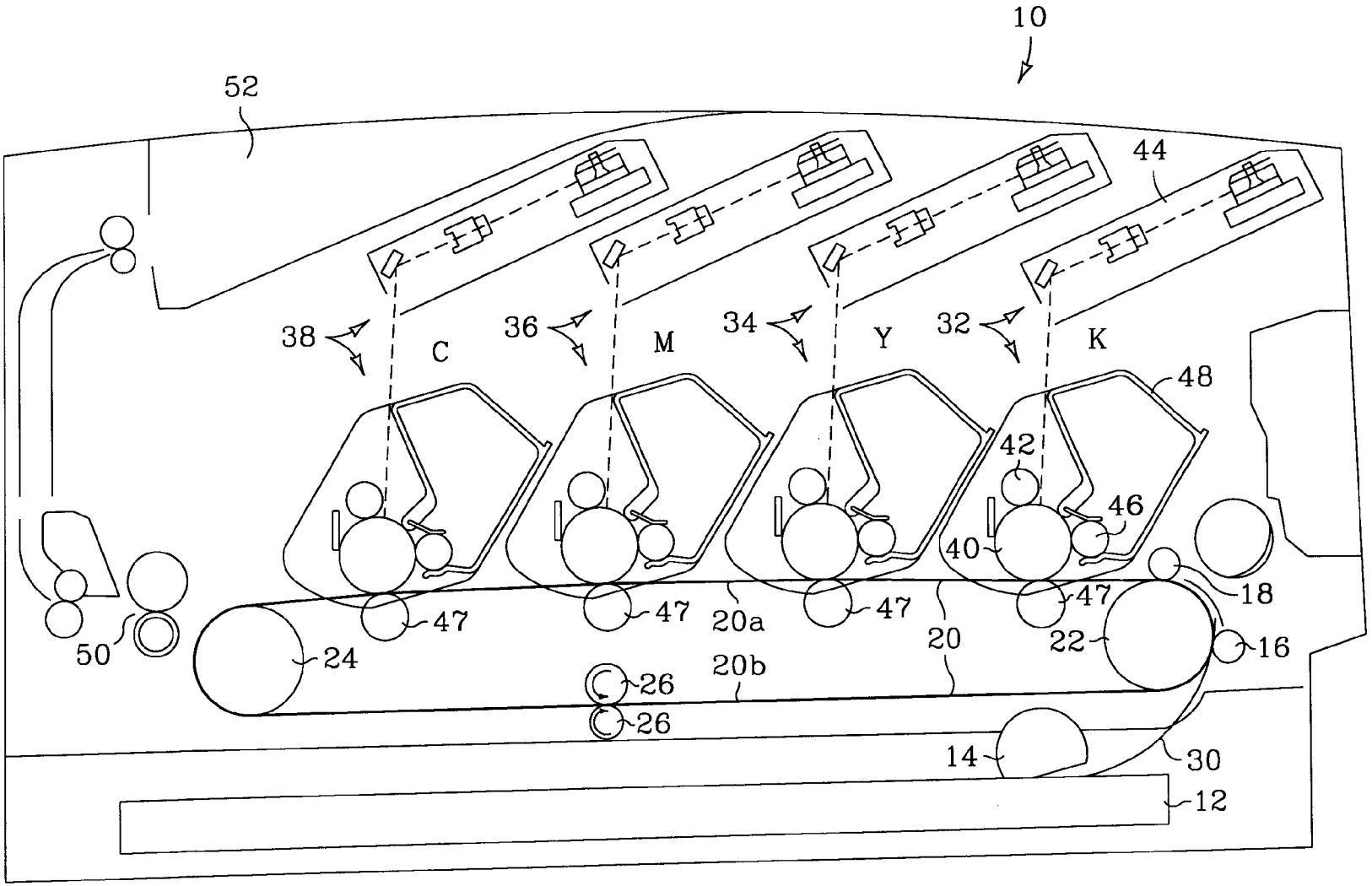
FIG. 1 is a representational side sectional view of a single pass color printer incorporating the present invention.

Although it is expected that the invention will be most useful in electrophotographic printing devices such as the single pass color laser printer illustrated in FIG. 1, the invention may be suitable for use in any single or multiple drum printer, copier, or other image forming device in which it is necessary of desirable to closely coordinate drum rotation.

FIG. 1 illustrates a single pass color laser printer, designated by reference number 10. Color laser printer 10 includes a media sheet transport system that includes media tray 12, pick roller 14, follower rollers 16, 18, transport belt 20, tensioning rollers 22, 24, and drive rollers 26. Pick roller 14 picks a media sheet 30, typically a sheet of paper, from tray 12 and advances sheet 30 toward follower rollers 16 and 18. Sheet 30 is grabbed between follower rollers 16, 18 and transport belt 20 and carried past developer stations 32, 34, 36 and 38 on upper run 20*a* of belt 20. Drive rollers 26 or another suitable mechanism engage the lower run 20*b* of belt 20 urging belt 20 to circulate around tensioning rollers 22, 24.

The desired print image is applied to each sheet 30 at developer stations 32, 34, 36, and 38. Each developer station is the same except that each contains a different color toner and is responsible for transferring a different color plane image to media sheet 30. For instance, developer station 32 contains black toner (K), developer station 34 contains yellow toner (Y), developer station 36 contains magenta toner (M), and developer station 38 contains cyan toner (C). Each developer station includes a photoconductor drum 40, a charge roller 42, a scanning laser 44, a developer roller 46 and a transfer roller 47. Each drum 40 is placed adjacent to one transfer roller 47 with transport belt 20 passing between the two. The toner supply for each developer station is maintained within a reservoir 48.

In operation, as belt 20 carries media sheet 30 toward the black developer station 32, charge roller 42 places a relative and uniform electrical charge on photoconductor drum 40. Repeatedly scanning a light beam horizontally across photoconductor drum 40 in a series of precise lines, scanning laser 44 creates a latent image of the corresponding color plane, in this case black, on the surface of photoconductor drum 40 by selectively discharging portions of photoconductor drum 40 according to the black color plane image. A difference in electrostatic charge density is created between the areas on drum 40 exposed and not exposed to the beam. Each color plane image is developed by electrostatic toners. As photoconductor drum 40 rotates the charged image, it passes by developer roller 46 enabling toner to be taken up from roller 46 onto the exposed or not exposed portions of photoconductor drum 40 depending upon the relative electrostatic charges of drum 40 and the toner. Thereafter, the toner image is rotated into contact with media sheet 30 which is pressed between photoconductor drum 40 and adjacent transfer roller 47. Transfer roller 47 is given an electrostatic charge opposite that of the toner. As media sheet 30 passes between photoconductor drum 40 and transfer roller 47, transfer roller 47 pulls the toner onto media sheet 30. The desired full color image is created as media sheet 30 passes through the remaining developer stations 34, 36, 38, each functioning in a substantially identical manner. Once each color plane image is transferred to media sheet 30, the toner is fused to media sheet 30 as the sheet passes between heated fusing rollers 50, and media sheet 30 is released to output bin 52.

Figure 2:
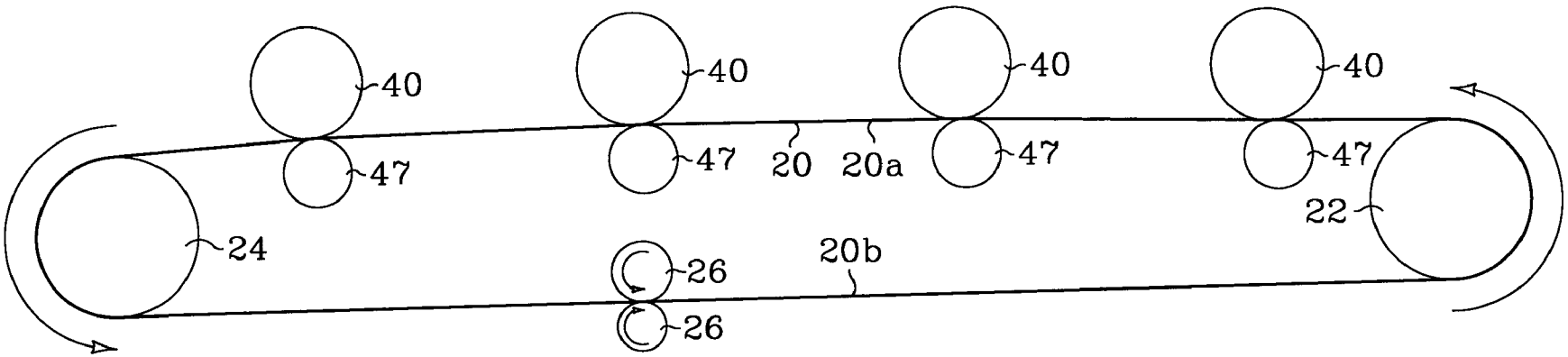
FIG. 2 is a schematic side sectional view of media sheet transport belt driven photoconductor drums according to one embodiment of the present invention.
Figure 3:
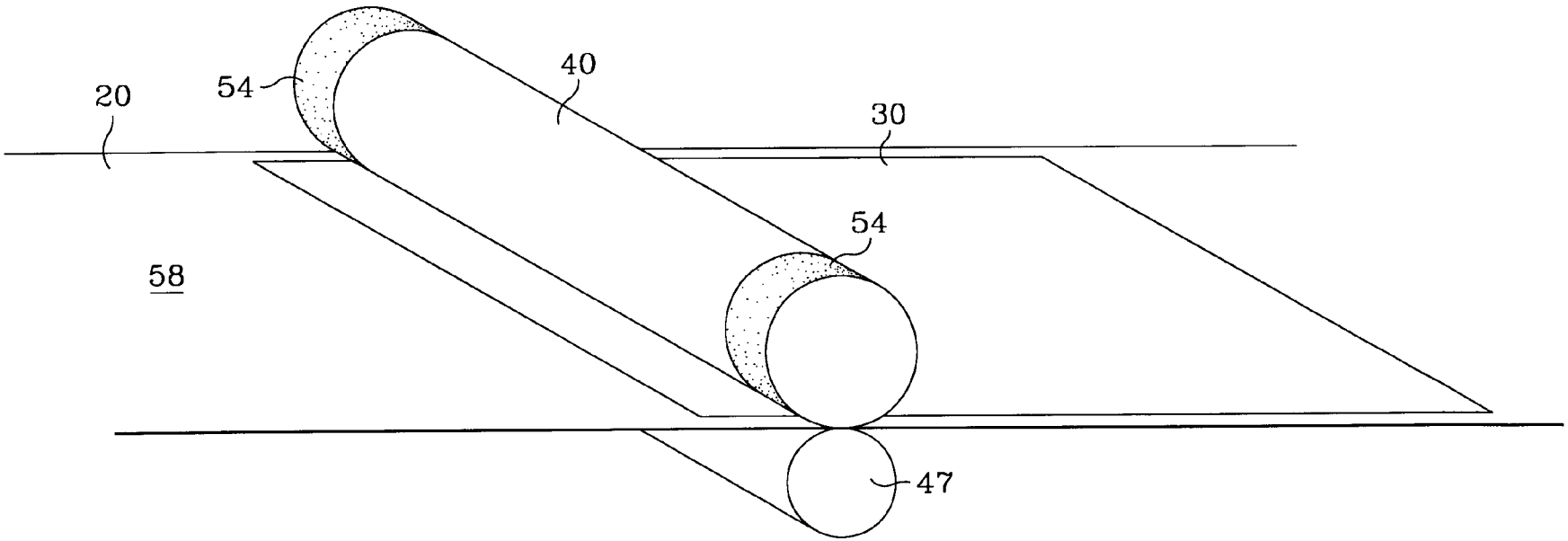
FIG. 3 is schematic view showing grit applied to the ends of the photoconductor drum to transfer driving force from the belt to the drum.

Referring now to FIGS. 2 and 3, instead of being individually driven by a separate motor and gear array as in a conventional printer, photoconductor drums 40 are commonly rotated by transport belt 20. Belt 20 engages each of the drums 40 simultaneously so that movement of belt 20 past drums 40 cause the drums to rotate while belt 20 carries media sheets 30 past the rotating drums. The transfer driving force from belt 20 to drums 40 is improved through grit 54 applied to one or both ends of drums 40. Grit 54 increases friction between photoconductor drums 40 and transport belt 20. It may be desirable in some operating environments that grit 54 extend in far enough to overlap media sheet 30. The increased friction on sheet 30 allows photoconductor drum 40 to secure the margins of media sheet 30 against belt 20 to help prevent media sheet 30 from slipping as belt 20 carries it past drum 40. The increased friction between photoconductor drum 40 and transport belt 20 also helps prevent photoconductor drum 40 from slipping as transport belt 20 circulates. As shown in FIG. 3, grit 54 is applied to contact and overlap transport belt 20 and, preferably, the margins of media sheet 30 as belt 20 carries media sheet 30 past photoconductor drum 40.

Figure 4:
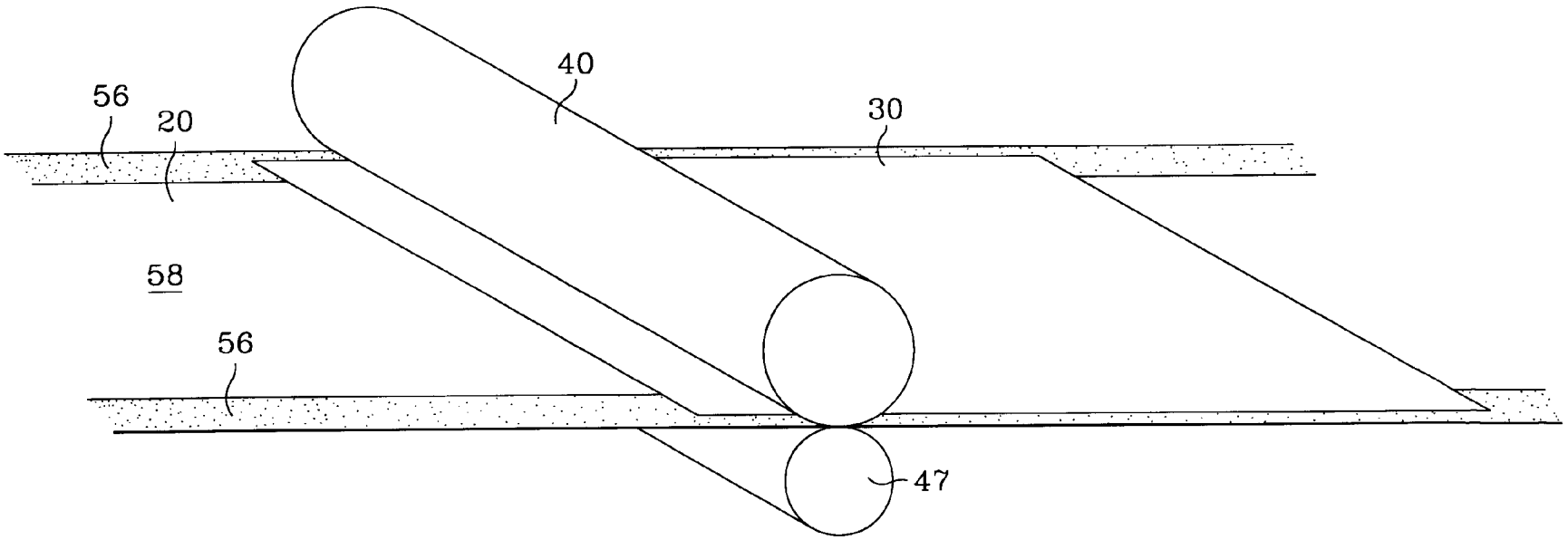
FIG. 4 is a schematic view showing grit applied to the sides of the transport belt to transfer driving force from the belt to the drum.

In an alternative embodiment of the invention shown in FIG. 4, grit 56 is applied along one or both edges on the outer surface 58 of belt 20. As above, grit 56 provides increased friction between photoconductor drum 40, media sheet 30, and transport belt 20. Again, the size and placement of grit 56 can be selected to allow grit 56 to contact and overlap both media sheet 30 and photoconductor drum 40 as belt 20 transfers media sheet 30 past drum 40. Grit 54, 56 can be formed by depositing and affixing a plurality of grit particles such as sand, metal flake, rubber bits, or other suitable material to selected surface areas of photoconductor drum 40 and transport belt 20. Alternatively, grit 54, 56 can be formed by roughening, machine etching, grinding, or cutting those surface areas of transport belt 20 and photoconductor drums 40. It is expected that a random distribution of grit particles applied to one or both ends of drum 40 in which the spacing between grit particles is less than ⅓ mm will be sufficient to transfer adequate driving force from belt 20 to drum 40. A random distribution of grit particles is preferred to help prevent the engagement of the belt to the drums from creating continuous frequencies that might contribute to banding. Also, it has been observed that bandwidths ⅓ mm or less are not visible when the printed sheets are viewed from 20 inches or more. Hence, it is expected that grit particles spaced ⅓ mm or less should be sufficient to prevent banding that is visible from 20 inches or more.

Figure 5:
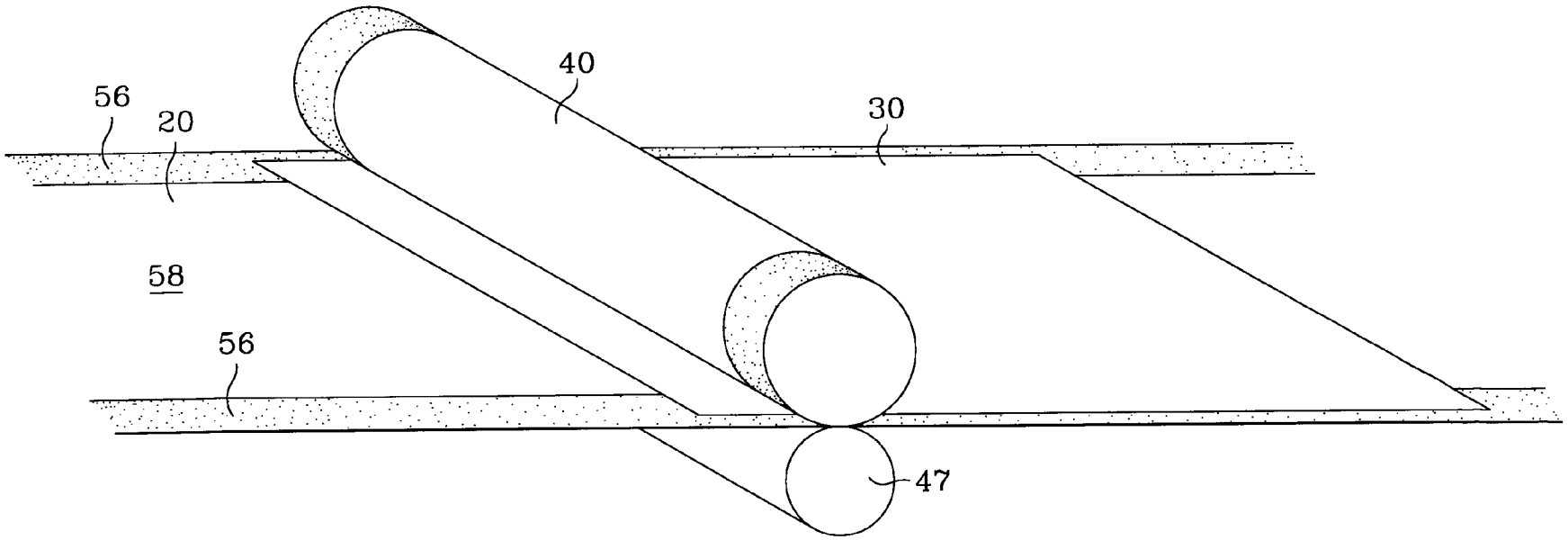
FIG. 5 is a schematic view showing grit applied to ends of the photoconductor drum and to the sides of the transport belt.

Although the present invention has been shown and described with reference to the foregoing exemplary embodiments, other embodiments are possible. For example, the invention could be used in a monochrome printer having only one photoconductor drum. One of the tension rollers 22 or 24 could be used to drive the belt in lieu of separate drive rollers 26. As shown in FIG. 5, grit may be applied to both drum 40 and belt 20 as may be necessary or desirable to transfer adequate driving force to drum 40. The type, size and density of the grit particles will likely vary depending on the particular printing device and environmental conditions. Other friction enhancement/driving force transfer mechanisms might also be used. The extent of the engagement between belt 20 and drums 40, the normal force exerted at the point of engagement between belt 20 and drums 40 and other factors may influence the specific characteristics of the engagement between belt 20 and drums 40. It is to be understood, therefore, that other forms, details, and embodiments may be made without departing from the spirit and scope of the invention which is defined in the following claims.

What is claimed is:

1. A belt drive system for multiple photoconductor drums, comprising:

a series of photoconductor drums;

a series of transfer rollers each adjacent to one of the photoconductor drums;

a first roller disposed upstream from the first in the series of drums and a second roller disposed downstream from the last in the series of drums;

an endless loop belt wrapping the first and second rollers, the belt having a generally horizontal upper run that carries media sheets and passes between and extends across the transfer rollers and the photoconductor drums, the upper run of belt simultaneously engaging each drum so that movement of the belt past the drums causes the drums to rotate as the belt carries media sheets past the rotating drums;

grit particles randomly distributed along a portion of the belt that engages each drum such that the spacing between the grit particles is less than or equal to ⅓ mm.

2. A single pass color printer, comprising:

a series of developer stations each configured to transfer a different color plane toner image to a media sheet and each developer station having a photoconductor drum and a transfer roller adjacent to the photoconductor drums;

a first roller disposed upstream from the first in the series of developer stations and a second roller disposed downstream from the last in the series of developer stations;

an endless loop belt wrapping the first and second rollers, the belt having a generally horizontal upper run that carries media sheets and passes between and extends across the transfer rollers and the photoconductor drums, the upper run of belt simultaneously engaging each drum so that movement of the belt past the drums causes the drums to rotate as the belt carries media sheets past the rotating drums;

grit particles randomly distributed along a portion of the belt that engages each drum such that the spacing between the grit particles is less than or equal to ⅓ mm;

a media tray disposed upstream from the developer stations for holding media sheets;

at least one feed roller operative to move media sheets from the media tray to the belt; and a fuser disposed downstream from the developer stations for fusing the toner images to the media sheets.

* * * * *